US005325594A

United States Patent [19]

Szafranski

[11] Patent Number: 5,325,594

[45] Date of Patent: Jul. 5, 1994

[54] HAND TOOL FOR CUTTING INSULATION BATTS

[76] Inventor: James P. Szafranski, 418 Water St., Ellsworth, Me. 04605

[21] Appl. No.: 44,721

[22] Filed: Apr. 12, 1993

[51] Int. Cl.[5] ..... B26B 9/00

[52] U.S. Cl. ..... 30/294; 30/293

[58] Field of Search ..... 30/280, 286, 287, 289, 30/293, 294

[56] References Cited

U.S. PATENT DOCUMENTS

| | | | |
|---|---|---|---|
| 4,443,942 | 4/1984 | Demeter | 30/294 |
| 4,569,133 | 2/1986 | Schmidt | 30/293 |
| 4,587,735 | 5/1986 | Walters et al. | 30/286 |
| 4,635,362 | 1/1987 | Brown | 30/294 |
| 5,075,974 | 12/1991 | McIlhatten | 30/294 |
| 5,189,795 | 3/1993 | Fortin | 30/294 |

*Primary Examiner*—Richard K. Seidel
*Assistant Examiner*—Paul M. Heyrana
*Attorney, Agent, or Firm*—Frederick R. Cantor

[57] ABSTRACT

A hand-operated tool for cutting fibrous compressible insulation batts, and similar fibrous compressible materials. The tool, includes an elongated cutter blade housing, and a planar sheet of plexiglass, bent into a "C"-shaped configuration. End portions of the "C"-shaped plexiglass sheet fit over the ends of the cutter blade housing, so that the "C"-shaped sheet forms a presser element for the insulation batt, when placed on the top surface thereof. When the cutter blade is drawn through the batt material, the presser element compresses the material into a relatively small thickness, so that the cutter blade is enabled to completely penetrate the batt material. An insulation batt, therefore, can be neatly and completely severed, with one pass of the cutting tool.

5 Claims, 2 Drawing Sheets

HAND TOOL FOR CUTTING INSULATION BATTS

BACKGROUND OF THE PRESENT INVENTION

The present invention, relates to hand-operated cutting tools.

The present invention, more particularly, relates to hand-operated tools for cutting insulation batts.

The present invention, most particularly, relates to hand-operated tools for cutting insulation batts, during the process of installing such insulation batts in a building wall, or between the rafters of a building.

U.S. Pat. No. 5,075,974, granted to Edward McIlhatten, on Dec. 31, 1991, discloses a cutting tool for use on insulation batts, or other fibrous compressible materials. The cutting tool comprises a utility knife housing, having a razor-type cutting blade, extending from one end thereof. The elongated housing is seated in a "U"-shaped cradle, that is attached to two parallel rods, or wires. Flexible straps extend around the cradle and the knife housing, to retain the knife housing in a fixed position on the cradle.

The parallel rods terminate in guide rings, near the end of the knife housing that carries the cutting blade. The parallel rods are reversely curved, to form a spring system, that includes wire-like posts, extending upwardly through the above-mentioned guide rings. The spring system can be positioned against a batt of insulation, to exert a compressing action on the fibrous batt material when a downward manual pressure is exerted on the knife housing. During downward motion of the knife housing, the guide rings slide down on the parallel posts, presumably for the purpose of ensuring a true vertical motion of the knife housing. After the insulation batt has been compressed, the knife housing can be drawn across the batt surface, so that the razor blade cuts through the compressed batt thickness.

The tool shown in U.S. Pat. No. 5,075,974, is believed to have some disadvantages. For example, the cost of manufacture is relatively high, because several component parts and assembly operations are required to form a complete assembly. The cradle has to be specially affixed to the parallel rods by bending edge areas of the cradle around the rod material. Several bending operations are required to form the wire, or rod, material into an operative spring shape. Also, the guide rings have to be specially formed, and the flexible straps have to be attached in some manner to the undersurface of the cradle. In light of the above, the overall cost of manufacture is believed to be relatively high.

Further, an operational disadvantage of the '974 patented system, is that the flexible straps are relatively close together, such that the knife housing is apt to wobble, or become loose, in the cradle, during operation. Also, the presence of the straps makes it somewhat difficult for the workman to get his hand around the knife housing. The straps and cradle add to the side-to-side bulk dimension of the tool, so that the workperson can not get a firm grip on the knife housing. Thus, the operator has to grip the straps, rather than the knife housing.

It is believed that the batt compressing action of the parallel rods, or wires, might also be less than satisfactory. Since the rods are spaced apart, they do not compress the batt, in the plane of the cutter blade. Instead, the rods, or wires, compress the batt in two parallel planes on either side of the cutter plane. Therefore, the cutter moves through batt material that is only partly compressed.

It is further believed that the wire-type posts may tend to bend, or buckle, since the associated guide rings move obliquely to the posts, during the downstroke of the knife housing. As the rings move down on the posts, the angulations of the rings on the posts change, so as to generate a twisting, or bending force on the posts.

Also, it is believed that the overall size of the tool assembly in the '974 patented arrangement, is excessive. As shown in FIG. 1 of the '974 patent, the overall length of the wire structure is appreciably greater than the length of the utility knife per se. A workman, working in close quarters, might find the '974 patented assembly too bulky for easy use. Additionally, it is believed that the wire construction is fragile and subject to bending of the wires. If the wires are bent out of parallelism, they will tend to spread apart when downward pressure is applied to the knife housing. In such an event, the guide rings would bind on the posts.

SUMMARY OF THE PRESENT INVENTION

A primary object of the present invention, is to provide hand-operated cutting tools.

A further object of the present invention, more particularly, is to provide hand-operated tools for cutting insulation batts.

Another object of the present invention, most particularly, is to provide hand-operated tools for cutting insulation batts, during the process of installing such insulation batts in a building wall, or between the rafters of a building.

The present invention contemplates a batt insulation cutting tool that does not have the noted disadvantages of the tool shown in U.S. Pat. No. 5,075,974. One preferred form of the present invention comprises a thick sheet of transparent plastic material, e.g., plexiglass, curved into a "C"-shaped cross section (when viewed along the edge of the sheet). Opposite ends of the curved plastic sheet have openings therein that fit around, or over, end areas of a conventional utility knife.

In the 'as-formed' shape of the curved plastic sheet, the end portions of the sheet are somewhat closer together than the corresponding ends of the knife housing. Therefore, the ends of the curved plastic sheet have to be slightly sprung apart, in order to install the curved sheet on the utility knife. When the curved plastic sheet is installed on the knife, the plastic material is under a tension stress, so that the end portions of the sheet are clamped to opposite ends of the knife housing. The curved sheet is thus firmly attached to the knife housing without any requirements for modifying, or altering, the knife housing construction. The thickness of the plastic sheet material is such that the sheet is essentially rigid, i.e., non-flexible, after installation on the utility knife.

The curved plastic sheet has a smooth planar surface facing away from the knife housing. A workman can grip the knife housing in normal fashion, while moving the knife blade down into the insulation batt material. The lower surface of the curved sheet, in operation, functions as a compressing device, to compress the batt material in advance of the cutter blade. A pulling force is exerted on the knife housing to advance the blade through the partially compressed batt material. Usually only one stroke of the blade is required to completely sever the batt material. During the cutting operation the smooth flat lower surface of the rigid plastic sheet slides along the batt surface.

As noted above, the present invention clearly overcomes many of the problems associated with the tool depicted in U.S. Pat. No. 5,075,974.

A BRIEF DESCRIPTION OF THE DRAWINGS

DESCRIPTION OF THE PREFERRED EMBODIMENTS OF THE PRESENT INVENTION

Figure 1:
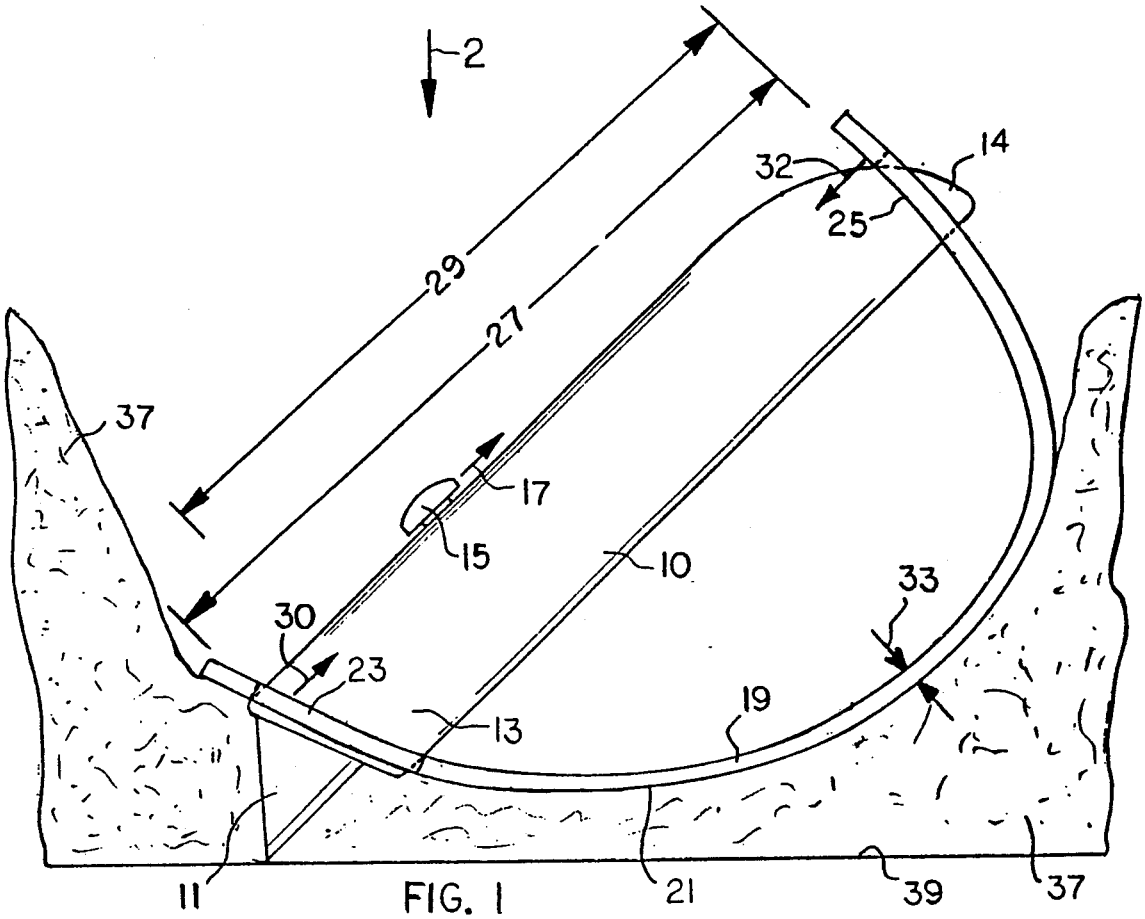
FIG. 1, is a side elevational view, of a hand-operated tool, embodying the present invention. An insulation batt is fragmentarily shown in association with the tool, e.g., during an insulation batt cutting operation.

FIG. 1, is a side elevational view, of a hand-operated tool, embodying the present invention. An insulation batt is fragmentarily shown in association with the tool, e.g., during an insulation batt cutting operation.

Figure 2:
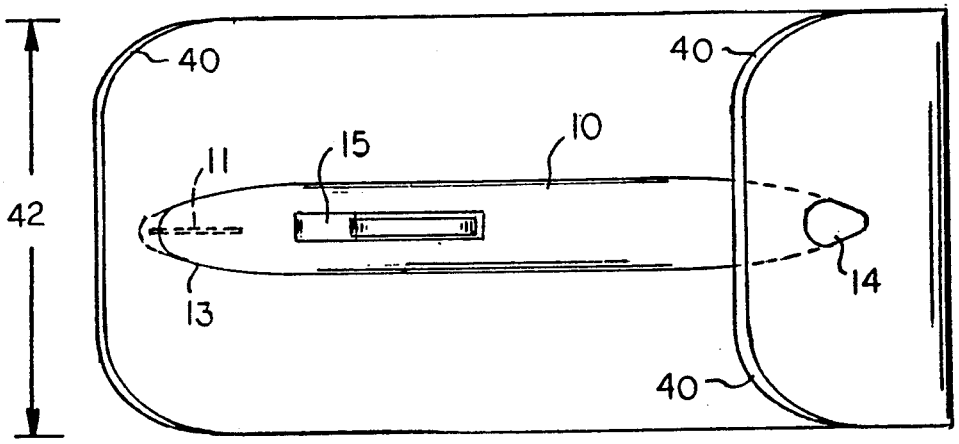
FIG. 2, is a plan view, of the FIG. 1 tool, taken in the direction of arrow 2, in FIG. 1.

FIG. 2, is a plan view, of the FIG. 1 tool, taken in the direction of arrow 2, in FIG. 1.

Referring now to FIGS. 1 and 2, there is shown a preferred hand cutting tool construction, comprising a conventional utility knife, having a retractable cutter blade. A curved planar sheet of material is attached to end areas of the knife housing, to form an insulation compression member. As viewed in FIG. 1, the curved sheet 19, has its lower surface 21, engaged with the surface of a fibrous compressible insulation batt 37, so that the tip of the cutter blade 11, is enabled to completely penetrate the batt 37 thickness. The batt 37, is severed by drawing the cutter blade housing 10, in a left-to-right direction, as viewed in FIG. 1.

With more particular reference to the drawings, FIG. 1, shows a conventional elongated cutter blade housing 10, having a cutter blade 11, extending through the left end 13. A blade carrier within the housing is connected to a thumb-operated push button 15, such that blade 11, can be retracted into cutter blade housing 10, by slidable motion of the button 15, in the arrow 17 direction.

The present invention relates, more particularly, to a curved planar wall element 19, preferably formed of transparent plexiglass, or a material having similar transparency and structural tensile characteristics. As viewed in FIG. 1, the wall element 19, has a "C"-shaped cross-section. However, in a direction normal to the plane of cutter blade 11, the wall element is flat, or planar, in a plane normal to the plane of FIG. 1.

The "C"-shaped wall element 19, has a left end portion 23, detachably fitting over the left end of the knife housing 10, and a right end portion 25, detachably fitting over the right end of the knife housing 10. Openings are formed in end portions 23 and 25, of the curved wall element 19, such that the ends of the knife housing 10, extend through the wall element 19 planes, whereby the cutter blade housing 10, is firmly connected at its opposite ends to the curved wall element 19.

When the curved wall element 19, is installed on the cutter blade housing 10, the end portions 23 and 25, are spaced apart by a distance 27. Typically, distance 27, is about five and one-half ($5\frac{1}{2}$) inches. However, in its 'as-formed' state, prior to installation on the cutter blade housing 10, curved wall element 19, has its end portions 23 and 25, spaced apart a lesser distance, represented by numeral 29, in FIG. 1. Typically, distance 29, is about five (5) inches.

In order to install the curved wall element 19, on the cutter blade housing 10, the end portions, 23 and 25, of the plastic wall element 19, are manually spread apart to a spacing slightly more than distance 27, after which the ends of the cutter blade housing 10, are snapped into, or through, the openings in end portions 23 and 25, of the curved wall element 19. The opening in end portion 23, has a slot configuration, such that it can freely pass over, or across, the cutter blade 11.

As viewed in FIG. 2, the end areas 13 and 14, of cutter blade housing 10, are tapered, or convergent. The openings in end portions 23 and 25, of the curved wall element 19, are sized to snugly fit the tapered ends 13 and 14, of the cutter blade housing 10, so that the plastic wall element 19, is under a tension stress, i.e., in the FIG. 1 condition of wall element 19, end portions 23 and 25, exert gripping forces in the directions of arrows 30 and 32, whereby the end portions 23 and 25, act as clamps to firmly retain wall element 19, on the cutter blade housing 10.

Wall element 19, has a preferred wall thickness dimension 33, measuring about one-quarter ($\frac{1}{4}$) inch, when the wall element 19, is formed of hard plexiglass material. The wall element 19, has resiliency in the detached condition. However, when the curved wall element 19, has its end portions 23 and 25, snapped over the ends 13 and 14, of the cutter blade housing 10, the curved wall element 19, is no longer resilient, or bendable, in the FIG. 1 plane. Instead, the curved wall element 19, becomes rigid and shape-retentive. In operation, the curved wall element 19, can be pressed downwardly against an insulation batt 37, and rigid support surface 39, without deforming, or losing, its "C"-shaped configuration.

As previously noted, the lower surface 21, of the curved wall element 19, is flat in a plane normal to the plane of blade 11, i.e., the plane of FIG. 1. When a person grips cutter blade housing 10, with one hand and exerts a downward force thereon, the flat planar surface 21, readily depresses and compresses the batt material. The batt cutting operation is achieved by manually moving the cutter blade housing 10, in a left-to-right direction. Sufficient downward force must be exerted on housing 10, to keep the tip of cutter blade 11, in contact with the support surface 39, i.e., to have the blade completely penetrate the batt thickness dimension. During operation, the batt can be completely severed with one stroke of the cutter blade 11.

As shown in FIG. 1, the cutting edge of blade 11, is angled to the batt lower surface, at an angle of about forty-five (45) degrees. However, the cutting angle is not critical, it can be more, or less, than forty-five (45) degrees, if desired.

Preferably the our (4) corners of the curved wall element 19, are rounded, as shown, e.g., at 40, in FIG. 2. The rounded corners 40, are not essential, but they present a lesser danger of injury to the operator, as compared to having sharp corners 40.

The resiliency of the wall element 19 material, enables wall element 19, to be removed from the cutter blade housing 10, i.e., by manually spreading end portions 23 and 25. Removal, or installation, of the curved wall element 19, is readily accomplished manually, without any tools.

The transverse width dimension 42, of wall element 19, may be about two and one-half ($2\frac{1}{2}$) or three (3)

inches. Dimension 42, is preferably at least three (3) times the corresponding width dimension of the cutter blade housing 10, so that when the curved wall element 19, is pressed downwardly toward support surface 39, the relatively wide, flat lower surface 21, will seat flatwise against surface 39, with the batt material 37, squeezed therebetween. With such an orientation of wall element 19, the plane of cutter blade 11, will be normal to the plane of surface 39, such that the cutter blade 11, will form a severed batt edge, that is precisely normal to the batt outer surface. The workman can achieve a desired right-angled batt edge without taking any special precautions.

Wall element 19, can be formed from a flat sheet of transparent plexiglass, having a thickness dimension 33. After the end openings have been formed through the sheet, the sheet can be reconfigured to the curved "C"-shaped configuration, using an appropriate form, together with heat and pressure. Alternately, the curved wall element 19, can be formed by a molding process.

Curved wall element 19, is preferably formed of a transparent material, since the transparency enables the workman to see the tip of the cutter blade 11, so that he can properly direct the blade 11, in the desired direction, usually cross-wise of the batt longitudinal dimension. Presumably wall element 19, could be formed of spring steel, or other non-transparent, or transparent, material with markings on the wall element upper surface to show the location of cutter blade 11.

Figure 3:
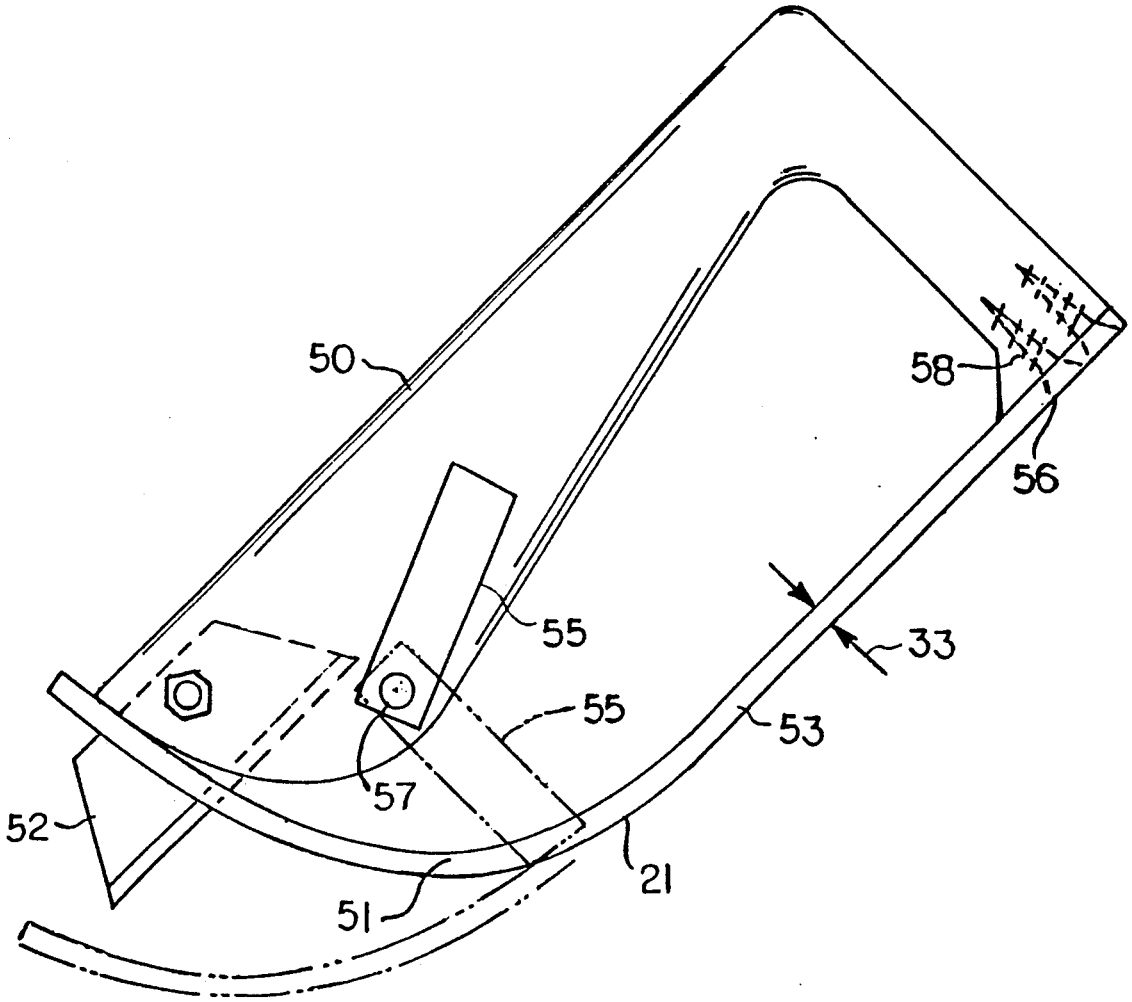
FIG. 3, is a side elevational view, of a second tool, constructed according to the present invention.

FIG. 3, is a side elevational view, of a second tool, constructed according to the present invention.

As indicated above, FIGS. 1 and 2, illustrate a preferred embodiment of the present invention. FIG. 3, shows a less preferred construction, that employs a specially constructed "L"-shaped housing 50, for a cutter blade 52. Housing 50, forms a handle that can be manually gripped to move the cutter blade 52, through the insulation batt, which is not shown in FIG. 3.

The insulation compression member, comprises a plexiglass sheet 53, having a thickness dimension 33, and a width dimension that is similar to width dimension 42, shown in FIG. 2. Blade 52, and housing, or handle, 50, are located on the longitudinal centerline of plastic sheet 53, similar to the arrangement depicted in FIG. 2. The curved portion of sheet 53, has a slot therein slightly wider than the thickness of blade 52, e.g., one-sixteenth (1/16) of an inch, such that the blade 52, can project from housing 50, through the plane of the plastic sheet 53. Numeral 51, designates the end of the slot.

Opposite ends of sheet 53, abut, or are secured to, housing 50, such that the sheet 53, is rigid and nonflexible, in response to pressure on its lower surface 21. FIG. 3, shows the sheet 53, in its ,as-formed, state, with end portion 56, thereof attached to housing 50, by means of screws 58. The other end of the sheet 53, abuts the end of the housing 50.

The tool construction of FIG. 3, has a safety feature, whereby the sharp tip of blade 52, can be shielded when it is desired to store the tool. A lever arm 55, is pivotably attached at 57, to the side surface of housing 50, so that it can be swung down to the dashed line position. The free end of the lever acts as a cam to deflect the curved portion of sheet 53, beyond the tip of cutter blade 52. The sheet thus serves as a shield to prevent injury to any one who might pick up, or otherwise make contact with the tool.

Operationally, the tool of FIG. 3, performs similarly to the tool depicted in FIGS. 1 and 2. The FIG. 1 tool construction, is preferred because of its simplicity and lower manufacturing cost.

The present invention describes a hand-operated tool for cutting fibrous compressible insulation batts, and simlar materials, that includes an elongated cutter blade housing, and a planar sheet of plexiglass, bent into a "C"-shaped configuration. Features of the present invention are recited in the appended claims. The drawings herein necessarily depict specific structural and appearance features and embodiments of the hand-operated tool, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A hand-operated tool for cutting a batt of soft fibrous insulation comprising:

an elongated cutter blade housing having a first end and a second end;

a cutter blade projecting out of said housing at said first end;

a one-piece insulation compression member formed of a transparent plastic material; said compression member comprising a planar sheet-like wall element having a first end portion detachably fitting onto the first end of the cutter blade housing, and a second end portion fitting onto the second end of the cutter blade housing;

said end portions of the planar wall element having socket openings therein fitting around the respective ends of the cutter blade housing to detachably connect the insulation compression member to the cutter blade housing;

said planar wall element is curved so that a central portion of said planar wall element is spaced away from said blade housing;

the curvature of said planar wall element being such that a person's hand can be curled around the blade housing within a free space formed between the end portions of the planar wall element, whereby said blade housing can be pulled across an insulation batt to enable said planar wall element to compress the batt material in advance of said cutter blade; and said planar wall element having a continuous uninterrupted batt compressing surface that is flat and smooth in a direction taken normal to the cutter blade, said batt compression surface uniformly compressing areas of an insulation batt contiguous to the blade.

2. The hand-operated tool, as described in claim 1, wherein said planar wall element has a "C"-shaped cross-section, when viewed in a direction normal to the plane of said cutter blade.

3. The hand-operated tool, as described in claim 1, wherein said planar wall element is formed of a sheet of plastic, having a thickness of about one-quarter inch.

4. The hand-operated tool, as described in claim 1, wherein said planar wall element is curved, so that in the 'as-formed' condition of said planar wall element, the spacing between said end portions of said wall element is less than the corresponding spacing when said planar wall element is installed on said cutter blade housing, whereby said planar wall element is in a tensioned condition when installed on said blade housing.

5. A hand-operated tool for cutting a batt of soft fibrous insulation comprising:

an elongated cutter blade housing having a first end and a second end;

a cutter blade projecting out of said housing at said first end;

a one piece insulation compression member formed out of a transparent plastic sheet material; and said insulation compression member comprising a planar wall element having a first end portion engaged with the first end of said blade housing, and a second end portion attached to said second end of said blade housing;

said first end portion of the planar wall element having an opening therein that has a clearance with respect to the cutter blade so that the blade projects through the planar wall element;

said planar wall element is curved so that a central portion of said planar wall element is spaced away from said blade housing;

said planar wall element being constructed so that a person's hand can be curled around the blade housing within a space formed by the central portion of said wall element, whereby said blade housing can be pulled across an insulation batt to enable the planar wall element to compress the batt material in advance of said cutter blade; and said planar wall element having a batt compression surface that is smooth and flat, said batt compression surface having a width dimension (42) that spans the cutter blade plane, whereby said surface is enabled to compress batt areas contiguous to the cutter blade.

* * * * *